US010461477B2

(12) United States Patent
Yamanaka

(10) Patent No.: US 10,461,477 B2
(45) Date of Patent: Oct. 29, 2019

(54) SHIELD CONNECTOR AND CONNECTOR ASSEMBLY INCLUDING THE SHIELD CONNECTOR

(71) Applicant: Molex, LLC, Lisle, IL (US)

(72) Inventor: Manabu Yamanaka, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/134,648

(22) Filed: Sep. 18, 2018

(65) Prior Publication Data

US 2019/0097358 A1 Mar. 28, 2019

(30) Foreign Application Priority Data

Sep. 22, 2017 (JP) ..... 2017-182202

(51) Int. Cl.
*H01R 13/6581* (2011.01)
*H01R 13/502* (2006.01)
*H01R 13/504* (2006.01)
*H01R 24/60* (2011.01)

(52) U.S. Cl.
CPC ..... *H01R 13/6581* (2013.01); *H01R 13/502* (2013.01); *H01R 13/5045* (2013.01); *H01R 24/60* (2013.01)

(58) Field of Classification Search
CPC ..... H01R 13/6581
See application file for complete search history.

(56) References Cited

U.S. PATENT DOCUMENTS

| | | | | |
|---|---|---|---|---|
| 7,976,342 | B2 * | 7/2011 | Farole | H01R 13/6581 439/607.57 |
| 8,215,997 | B2 * | 7/2012 | Hsia | H01R 13/6581 439/660 |
| 8,827,742 | B2 | 9/2014 | Wang | |
| 9,431,734 | B2 * | 8/2016 | Guo | H01R 12/722 |
| 9,887,485 | B2 * | 2/2018 | Lambie | H01R 13/5219 |
| 2017/0229817 | A1 * | 8/2017 | Tsai | H01R 13/6581 |

FOREIGN PATENT DOCUMENTS

| | | |
|---|---|---|
| JP | 2011-054571 A | 3/2011 |
| JP | 2013-143378 A | 7/2013 |
| JP | 2016-051541 A | 4/2016 |

* cited by examiner

*Primary Examiner* — Tho D Ta
(74) *Attorney, Agent, or Firm* — Molex, LLC

(57) ABSTRACT

A connector that is connected to a mating connector includes: an outer housing; and an inner housing module fit in the outer housing. The inner housing module includes: a resin portion including an attachment portion and a base portion extending from the attachment portion; upper surface shield plates and side surface shield plates that are provided on an outer side of the base portion, and are electrically connected to each other; and a signal terminal provided on an inner side of the base portion, and the upper surface shield plates, the side surface shield plates, the signal terminal, and the resin portion are integrally formed.

14 Claims, 9 Drawing Sheets

SHIELD CONNECTOR AND CONNECTOR ASSEMBLY INCLUDING THE SHIELD CONNECTOR

RELATED APPLICATIONS

This application claims priority to Japanese Application No. 2017-182202, filed Sep. 22, 2017, which is incorporated herein by reference in its entirety.

TECHNICAL FIELD

The present disclosure relates to a connector and a connector assembly obtained by fitting the connector with a mating connector, and more particularly to a shield connector and a connector assembly including the shield connector.

BACKGROUND ART

A conventionally known connector is formed by integrating a terminal with a mold housing made of insulating resin, attaching the terminal and the housing thus integrated to a cylindrical conductive shell, and attaching a box-shaped outer housing made of resin.

For example, Patent Document 1 discloses a configuration where a plurality of terminals are fixed to be integrated with an insulating main body (mold housing), the insulating main body and the terminals thus integrated are attached to a metal shell that is a substantially cylindrical conductive shell, and an insulating shell that is an outer housing is attached to be on an outer side. In Patent Document 1, the insulating main body, insert molded with the terminals, the metal shell, and the insulating shell are separately formed as independent elements.

A configuration including a large number of independent elements separately formed results in an excessively large end product because each of the elements requires to be held by a holding portion with a clearance for insertion. Furthermore, the independent elements are not stably positioned.

Patent Document 1: Japanese Unexamined Patent Publication No. 2013-143378

SUMMARY

The disclosure is made in view of the above, and an object of the disclosure is to provide a connector and a connector assembly that involve a smaller number of portions where attachment portions or clearances for press fitting for assembling individual elements are required, and thus can be downsized.

The disclosure is proposed to achieve the object described above, and a first aspect according to the disclosure provides a connector that is connected to a mating connector, the connector including: an outer housing; and an inner housing module fit in the outer housing. The inner housing module includes: a resin portion including an attachment portion and a base portion extending from the attachment portion; upper surface shield plates and side surface shield plates that are provided on an outer side of the base portion, and are electrically connected to each other; and a signal terminal provided on an inner side of the base portion, and the upper surface shield plates, the side surface shield plates, the signal terminal, and the resin portion are integrally formed.

The inner housing module may include two divided segments that each have a substantially L shape in a cross-sectional view, and are combined with one flipped upside down relative to the other. The outer housing may include a shield plate insertion groove into which the upper surface shield plates and the side surface shield plates of the inner housing module are inserted. The upper surface shield plates may each have a side surface provided with a bent piece, the side surface being opposite to the side surface shield plate.

According to the disclosure, a connector and a connector assembly obtained by fitting the connector with a mating connector that involve a smaller number of portions where attachment portions or clearances for press fitting for assembling individual elements are required, and thus can be downsized.

BRIEF DESCRIPTION OF THE DRAWINGS

FIG. 4A is a view from a receptacle connector side (forward side), and FIG. 4B is a view from a connection plate side (backward side).

FIG. 5A is a view of an outer portion from the receptacle connector side (forward side), FIG. 5B is a view of the outer portion from a wire side (backward side), FIG. 5C is a view of an inner portion from the receptacle connector side (forward side), and FIG. 5D is a view of the inner portion from the wire side (backward side).

FIG. 6A is a perspective view, FIG. 6B is a cross-sectional view taken along line A-A in FIG. 6A, and FIG. 6C is a cross-sectional view taken along line B-B in FIG. 6A.

FIG. 9A is a view from the receptacle connector side (forward side), and FIG. 9B is a view from the connection plate side (backward side).

FIG. 10A is a view of an outer portion from the receptacle connector side (forward side), FIG. 10B is a view of the outer portion from the wire side (backward side), FIG. 10C is a view of an inner portion from the receptacle connector side (forward side), and FIG. 10D is a view of the inner portion from the wire side (backward side).

DETAILED DESCRIPTION OF THE PREFERRED EMBODIMENTS

Figure 1:
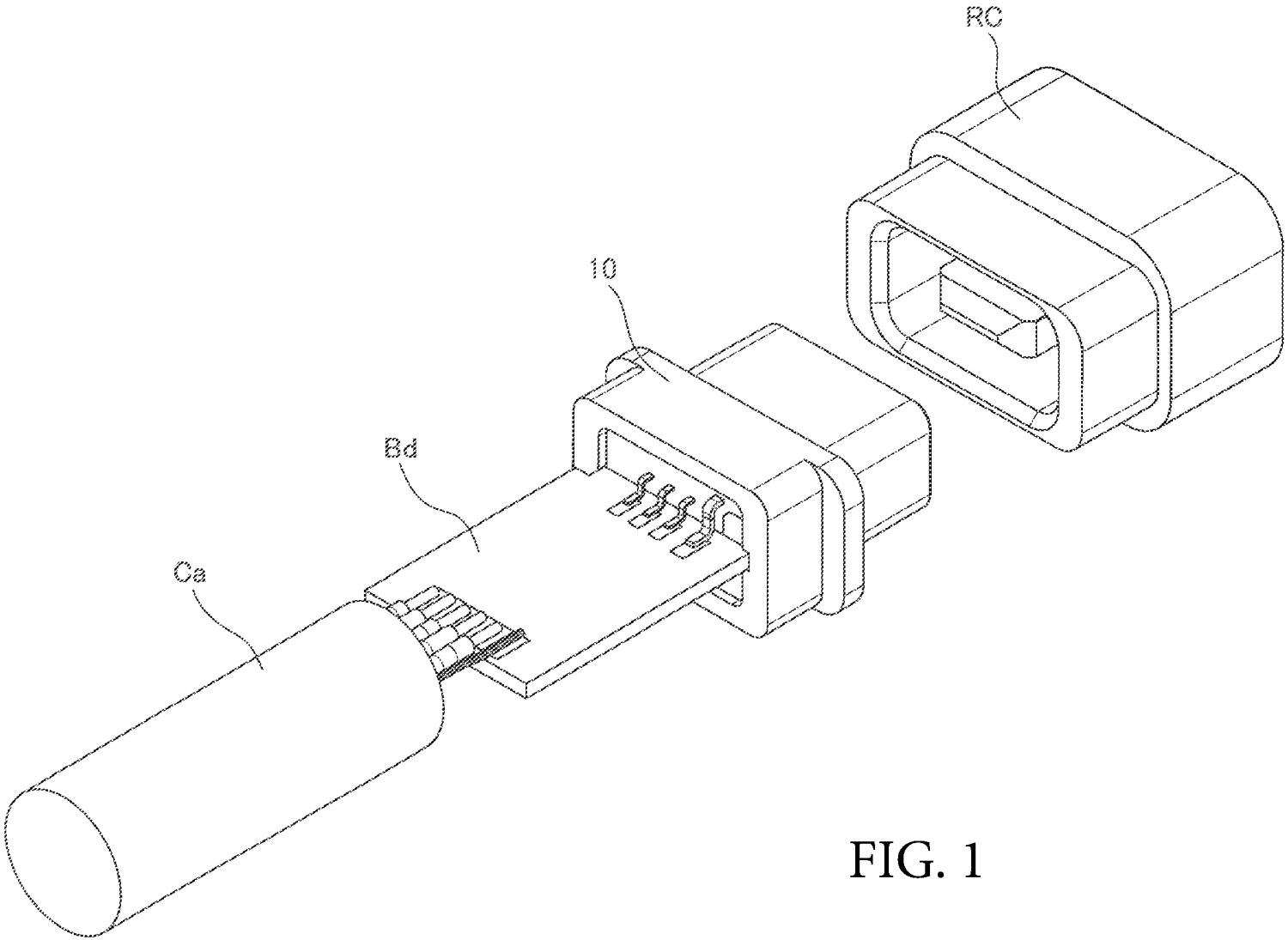
FIG. 1 is a perspective view illustrating a state in which a plug connector according to a first embodiment is used.

Preferred embodiments of the disclosure will be described in detail below with reference to the drawings. The same elements are denoted with the same reference numerals through the description of embodiments. A connector is a plug connector for example, and has a back surface on the side on which a cable is attached, a front surface that is on the opposite side of the back surface and is fit with a receptacle connector that is a mating connector, a right side surface that continues from and is on the right side as viewed from the back surface, a left side surface that continues from and is on the left side as viewed from the back surface, an upper surface that is on an upper side of the drawings, and a lower surface that is on a side opposite to the upper surface. The description is given with backward representing a direction from the front surface toward the back surface, forward representing the direction opposite to the backward direction, upward representing a direction from the lower surface toward the upper surface, downward representing a direction opposite to the upward direction, leftward representing a direction from the right side surface toward the left side surface, and rightward representing a direction opposite to the leftward direction.

A plug connector 10 according to a first embodiment is described with reference to FIG. 1 through FIG. 8. As illustrated in FIG. 1, the plug connector 10 has a back surface connected to a connector plate Bd that is connected to a cable Ca. The plug connector 10 has a front surface fit to a receptacle connector RC serving as a mating connector. The connector plate Bd and the cable Ca are partially covered with an outer cover (not illustrated). The connector plate Bd, the cable Ca, and the receptacle connector Rc described herein are merely examples, and thus are not limited to those illustrated in the figure. For example, the receptacle connector may be the element denoted with 10, and the plug connector may be the element denoted with RC.

Figure 2:
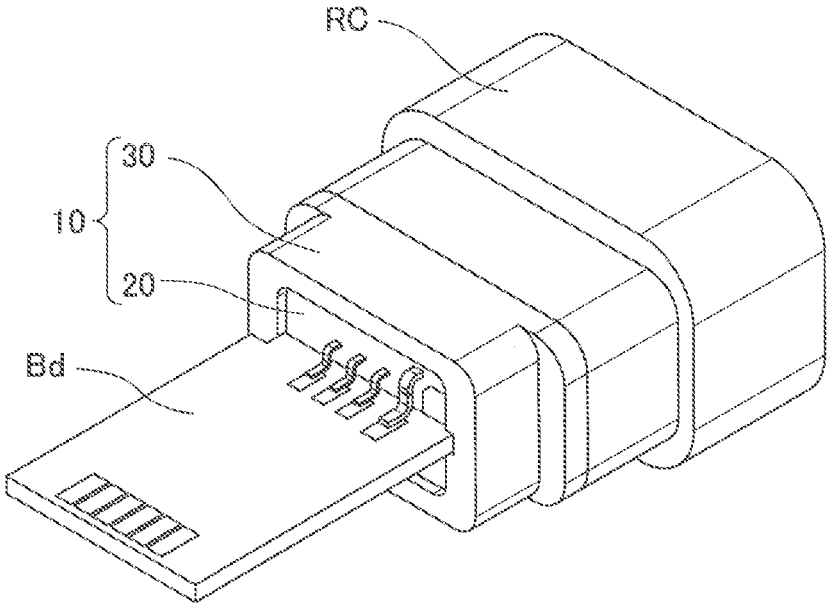
FIG. 2 is a perspective view illustrating a state where the plug connector and a receptacle connector are connected.
Figure 3:
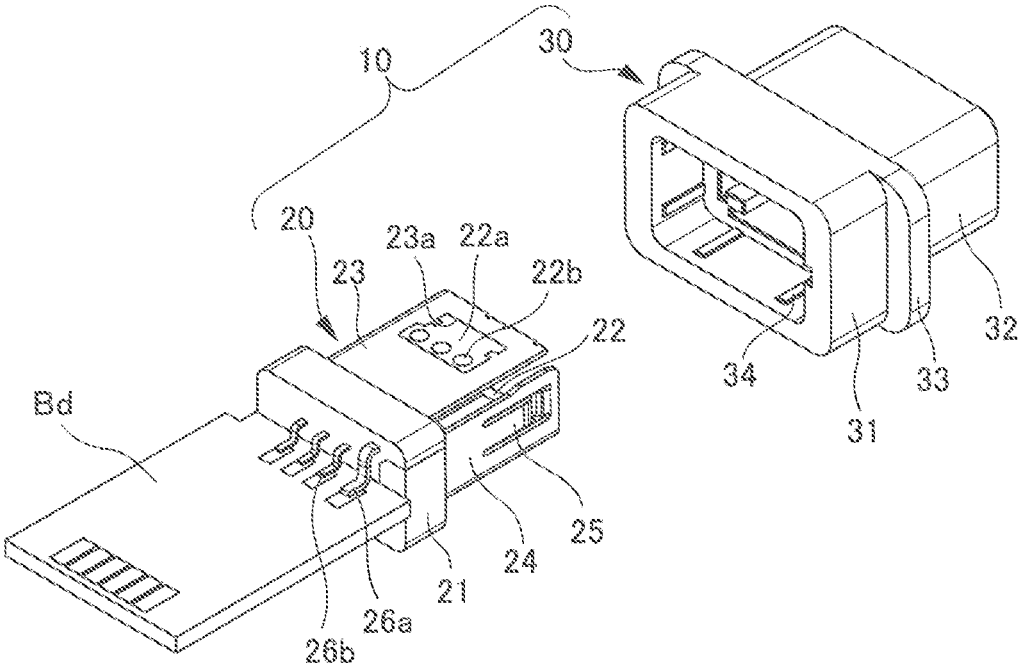
FIG. 3 is an exploded perspective view illustrating an inner housing and an outer housing forming the plug connector.

As illustrated in FIG. 2, the plug connector 10 includes an inner housing module 20 and an outer housing 30. The inner housing module 20 includes upper surface shield plates 23, side surface shield plates 24, and signal terminals 26*b* integrally formed by integral molding. The outer housing 30 is fit to the receptacle connector RC. FIG. 3 illustrates the plug connector 10 divided into the inner housing module 20 and the outer housing 30. The inner housing module 20 is fit in the outer housing 30 in a manner described below.

As illustrated in FIG. 3, the inner housing module 20 includes, as resin portions, an attachment portion 21, on the backward side, connected to the connector plate Bd and a base portion 22 extending forward from the attachment portion 21. The attachment portion 21 and the base portion 22 are integrally formed in a manner described later with reference to other drawings. The upper surface shield plates 23 and the side surface shield plates 24 are provided on the outer side of the base portion 22. The upper surface shield plates 23 and the side surface shield plates 24 are made of metal plate materials, and are integrally formed to be members each having an L-shaped cross-section taken along a direction orthogonal to the forward and backward direction (hereinafter, referred to as cross-sectional view) or to be in a box shape. The plug connector 10 can be used upside down, and thus the term upper surface shield plate 23 includes a case where it is located on the downward side. The term side surface shield plate 24 includes cases where it is located to be on the left and the right surfaces.

The upper surface shield plate 23 is provided with a shield plate opening 23*a* from which an inner housing fixing portion 22*a* that is a part of the base portion 22 is exposed. The inner housing fixing portion 22*a* is provided with a hole portion 22*b*. The side surface shield plate 24 is provided with a spring portion 25 for locking engagement with the receptacle connector RC. The upper surface shield plate 23 is rigidly integrated with the base portion 22 to be the inner housing module 20, with the inner housing fixing portion 22*a* filling the shield plate opening 23*a*.

Shield terminals 26*a* and the signal terminals 26*b* each have a distal end extending backward from the attachment portion 21 to be connected to the connector plate Bd. The shield terminals 26*a* pass through the attachment portion 21 and continue to the upper surface shield plate 23 and the side surface shield plate 24. The signal terminals 26*b* pass through the attachment portion 21 to extend on the base portion 22. The number of the shield terminals 26*a* and the signal terminals 26*b* can be set as appropriate, and thus is not limited to that illustrated in the figures.

The outer housing 30 includes a connection portion 31 on the backward side, a container portion 32 extending forward, and a flange 33 positioned between these. The inner housing module 20 is inserted to the container portion 32 through the connection portion 31. The connection portion 31 has an inner side provided with ribs 34 that guide the inner housing module 20 and come into contact with the attachment portion 21 of the inserted inner housing module 20 to ensure engagement.

Figure 4A:
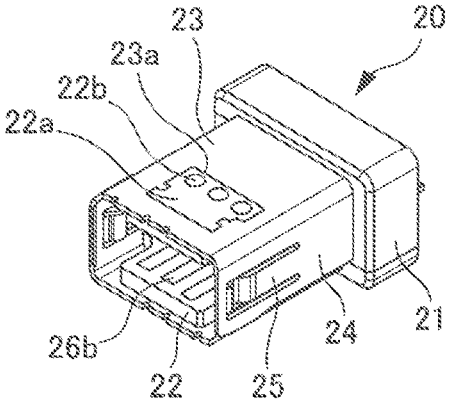
FIGS. 4A-4B are perspective views of the inner housing, where
Figure 4B:
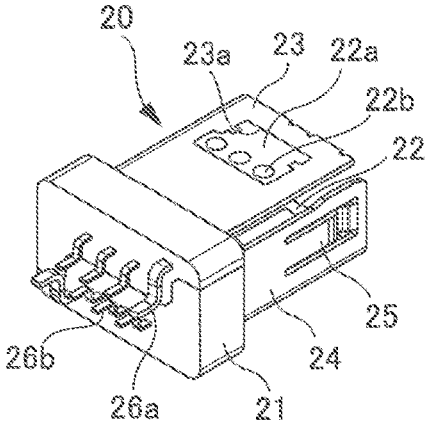

FIGS. 4A and 4B each illustrate the inner housing module 20 alone. As described above, the inner housing module 20 illustrated in FIG. 4A includes the base portion 22 that extends forward from the attachment portion 21 on the backward side. The signal terminals 26*b* are embedded, with their surfaces exposed, on the base portion 22. When the plug connector 10 is fit to the receptacle connector RC, the signal terminals 26*b* on the base portion 22 are connected to the signal terminal of the receptacle connector RC. The upper surface shield plate 23 and the side surface shield plate 24, continuing from the shield terminals 26*a*, provide an electrical shield between the inner and the outer side of the inner housing module 20.

The inner housing module 20 is obtained by integrally over-molding the upper surface shield plate 23, the side surface shield plate 24, the shield terminals 26*a*, and the signal terminals 26*b* with the elements described above, that is, the attachment portion 21 and the base portion 22 that are the resin portions. With the elements integrally formed to be the inner housing module 20, clearances that would otherwise be required for inserting various terminals and shells encompassing the terminals to the outer housing 30 can be reduced. Furthermore, compared with a case where independent elements are assembled, the elements can be more stably positioned. With the inner housing module 20 integrally formed, the shape of the outer housing 30 can be simplified.

The inner housing module 20 may be formed by integrating inner housing modules 20A and 20B instead of being formed as a box type. The inner housing modules 20A and 20B are segments each having an L-cross-sectional shape in a cross-sectional view taken along a direction orthogonal to the forward and backward direction (hereinafter, referred to as a cross-sectional view), and are combined with one flipped upside down relative to the other. This combined configuration can achieve higher processability while reducing the clearances and without compromising impact resistance.

Figure 5A:
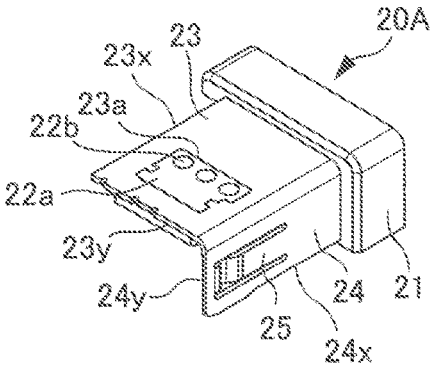
FIGS. 5A-5D are perspective views of L-shaped divided segments of the inner housing, where
Figure 5B:
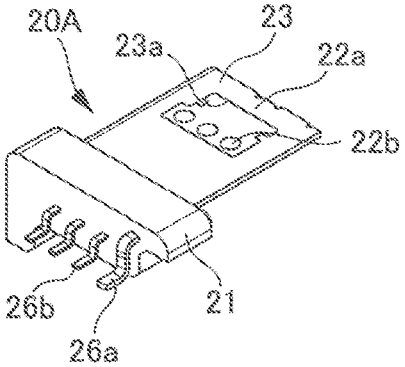
Figure 5C:
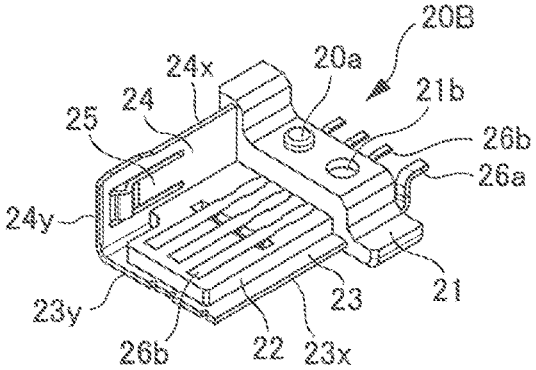
Figure 5D:
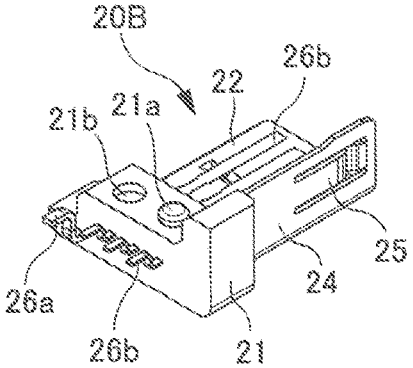

Specifically, as illustrated in FIGS. 5A-5D, the inner housing module 20 is divided into the two inner housing modules 20A and 20B, along a diagonal line in the cross-sectional view. FIG. 5A and FIG. 5B each correspond to the outer portion of the inner housing module 20A. FIG. 5C and FIG. 5D each correspond to the inner portion of the inner housing module 20B.

The inner housing module 20A and the inner housing module 20B have the same structure, and each include a divided segment of the attachment potion 21, a single base portion 22, a single upper surface shield plate 23, and a side surface shield plate 24 extending from the upper surface shield plate 23 to be one of side surfaces. The upper surface shield plate 23 has long sides 23 along a longitudinal direction and short sides 23*y* along a width direction. The side surface shield plate 24 has long sides 24*x* along the longitudinal direction and short sides 24*y* along a height direction. The divided segment of the attachment portion 21 is formed to have a step shape along the L shape in the cross-sectional view, and has an intermediate portion provided with an attachment protrusion 21*a* and an attachment recess 21*b*. The inner housing module 20A and the inner housing module 20B, one of which is flipped upside down relative to the other, are combined with their attachment protrusions 21*a* fitting in their attachment recesses 21*b*.

Figure 6A:
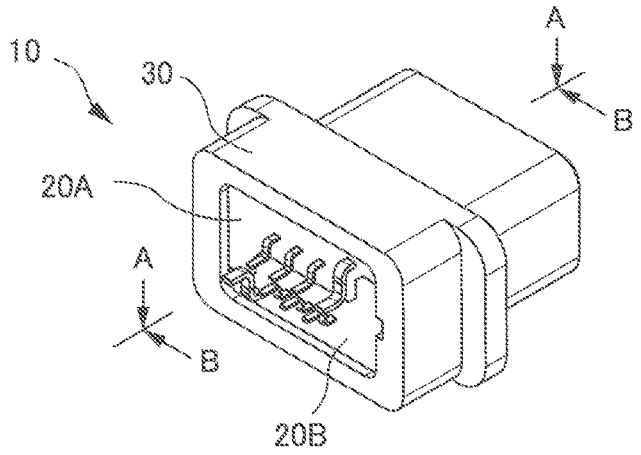
FIGS. 6A-6C are views for illustrating an inner portion of the plug connector after assembly, where
Figure 6B:
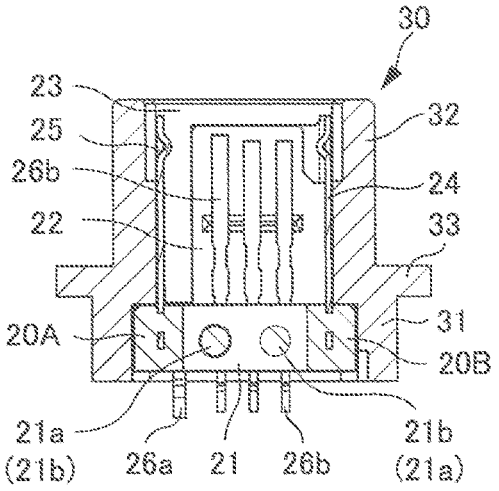
Figure 6C:
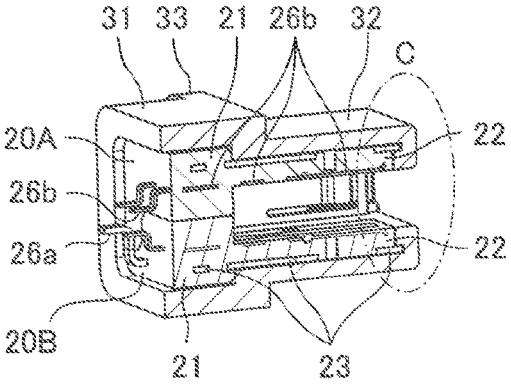

FIGS. 6A-6C illustrate an inner structure of the plug connector 10 formed by fitting the outer housing 30 with the combination of the inner housing module 20A and the inner housing module 20B. FIG. 6B is a cross-sectional view taken along line A-A in FIG. 6A. As illustrated in the figure, the inner housing modules 20A and 20B have the attachment portions 21 fit to the connection portion 31 of the outer housing 30, and have the upper surface shield plate 23 and the side surface shield plate 24 fit to the container portion 32 of the outer housing 30.

The attachment portions 21 of the inner housing modules 20A and 20B are meshed with each other in the upward and downward direction. The inner housing module 20A on the upward side has the attachment protrusion 21*a* inserted in the attachment recess 21*b* of the inner housing module 20B on the downward side, and has the attachment recess 21*b* receiving the attachment protrusion 21*a* of the inner housing module 20B on the downward side.

FIG. 6C is a vertical cross-sectional view taken along line B-B in FIG. 6A. FIG. 6C illustrates the combination of the inner housing modules 20A and 20B, and also illustrates the attachment portion 21, the base portion 22, the upper surface shield plate 23 (including the side surface shield plate 24), the shield terminals 26*a*, and the signal terminals 26*b* integrally over-molded as described above.

Thus, the attachment portion 21 and the base portion 22 are formed of a single member, and the upper surface shield plate 23 is embedded in the outer side of the base portion 22 while having one end extending through the attachment portion 21 to be the shield terminals 26*a*. The signal terminals 26*b* are embedded in the inner side of the base portion 22 while having one end extending through the attachment portion 21. FIG. 6C includes an area C illustrating the mode of an attachment of the upper surface shield plate 23 and the outer housing 30, which will be described in another section.

Figure 7:
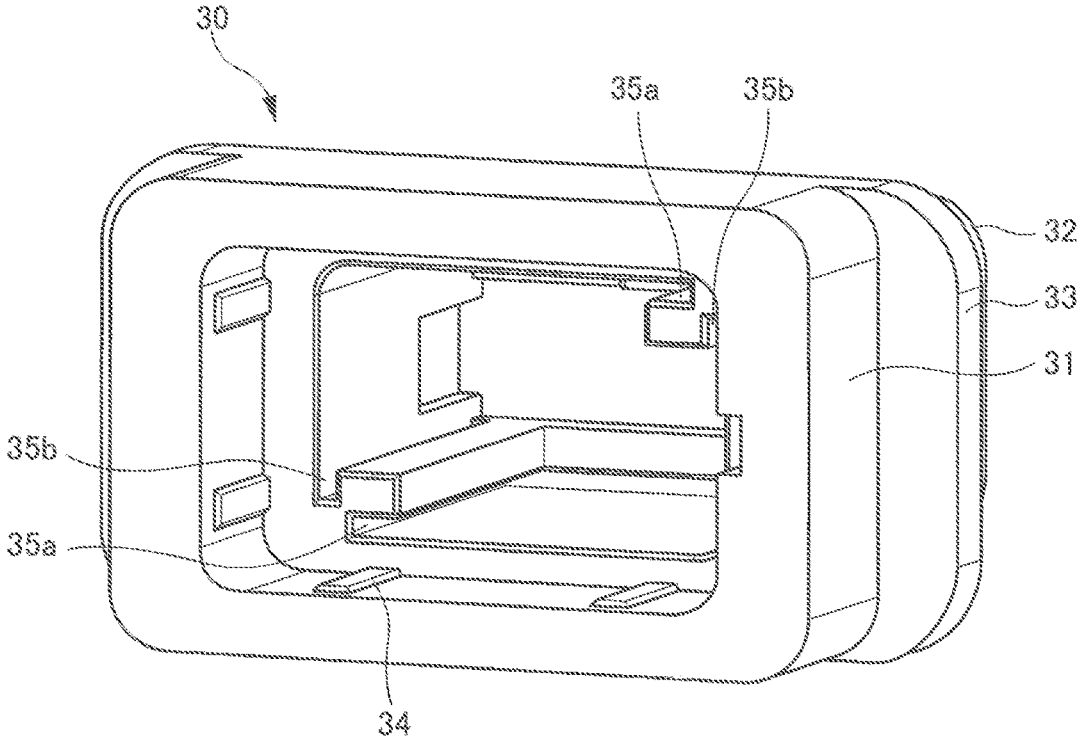
FIG. 7 is a view for illustrating an inner portion of the outer housing.

As illustrated in FIG. 7, the outer housing 30 has an interior provided with upper surface shield plate insertion grooves 35*a* into which the upper surface shield plates 23 of the inner housing modules 20A and 20B are inserted, and side surface shield plate insertion grooves 35*b* into which the side surface shield plates 24 are inserted. The upper surface shield plate insertion grooves 35*a* are each formed to have an L shape in plan view as viewed from the upward side in the figure, and the side surface shield plate insertion grooves 35*b* each have an I shape in plan view. The upper surface shield plate insertion grooves 35*a* and the side surface shield plate insertion grooves 35*b* are collectively referred to as a shield plate insertion groove.

Figure 8:
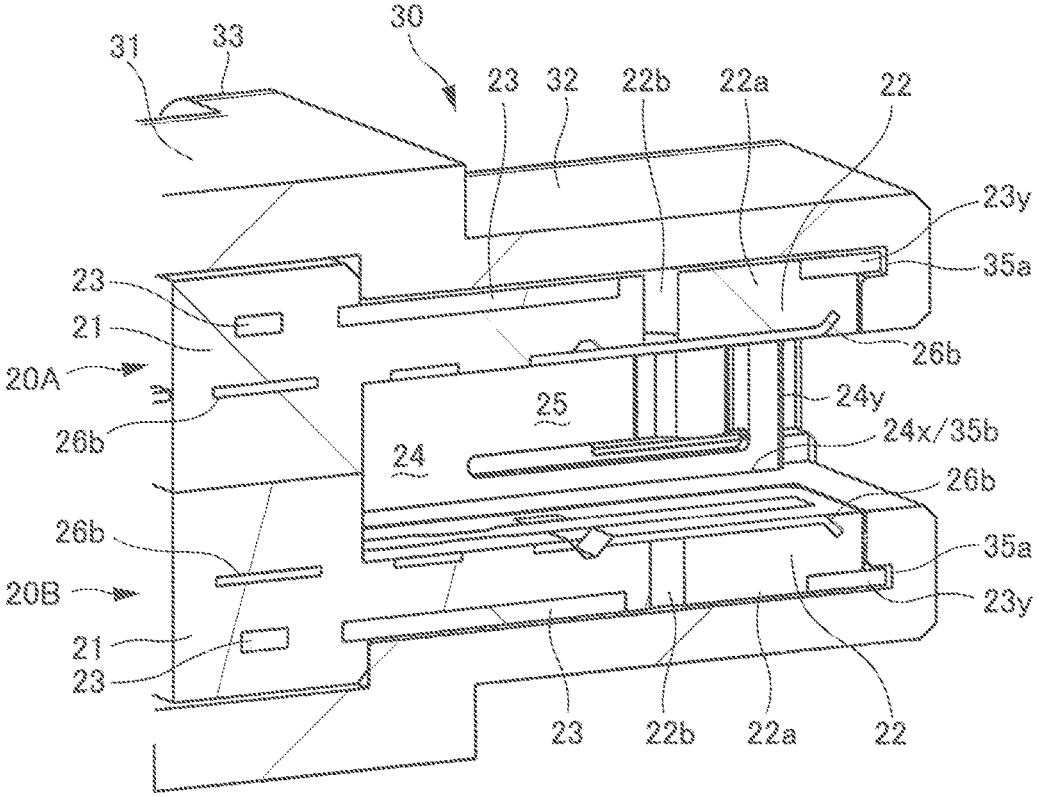
FIG. 8 is an enlarged view of an area C in FIG. 6C.

FIG. 8 is an enlarged view of the area C in FIG. 6C. The long side 23*x* and the short side 23*y* (see FIGS. 4A-B) of the upper surface shield plate 23 are inserted in the upper surface shield plate insertion groove 35*a* (see FIG. 7) having the L shape, with the short side 23*y* fit to the forward side of the upper surface shield plate insertion groove 35*a* as illustrated in FIG. 8. The side surface shield plate 24 has the long sides 24*x* inserted in the side surface shield plate insertion groove 35*b* having the I shape, and has the short sides 24*y* open.

As described above, the upper surface shield plate 23 and the side surface shield plate 24 are respectively inserted into the upper surface shield plate insertion groove 35*a* and the side surface shield plate insertion groove 35*b*, so that buckling and the like can be prevented due to the base portion 22 raised when the inner housing module 20 is attached to the outer housing 30.

The mode illustrated in FIG. 1 to FIGS. 4A-4B and FIGS. 6A-6C to FIG. 8 applies to both of the configuration where the inner housing module 20 is of a box type and the configuration where the inner housing module 20 is a combination of the divided segments.

A plug connector 10 according to a second embodiment is described with reference to FIGS. 9A-9B and FIGS. 10A-10D.

Figure 9A:
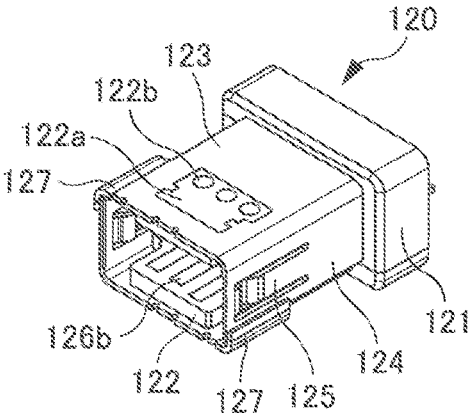
FIGS. 9A-9B are perspective views illustrating an inner housing according to a second embodiment, where
Figure 9B:
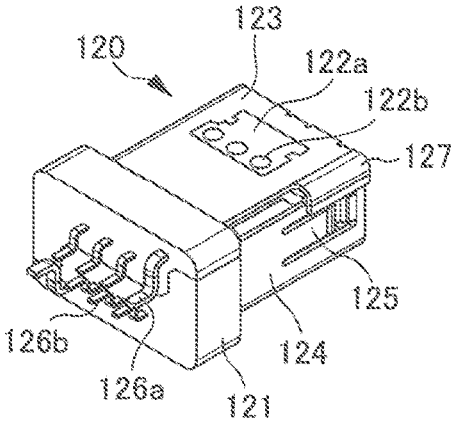
Figure 10A:
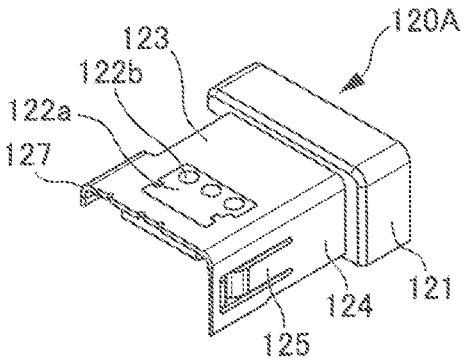
FIGS. 10A-10D are perspective views of L-shaped divided segments of the inner housing according to the second embodiment, where
Figure 10B:
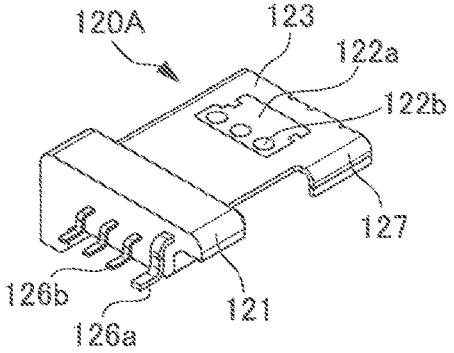
Figure 10C:
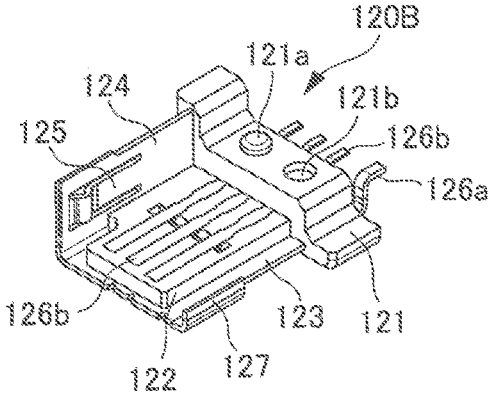
Figure 10D:
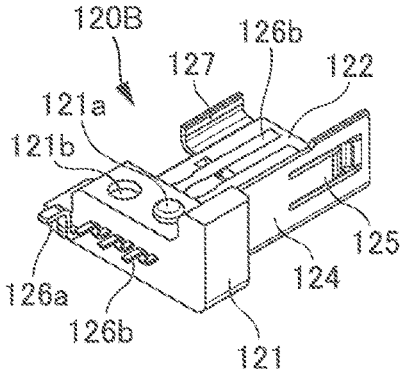

FIG. 9A and FIG. 9B each illustrate an inner housing module 120 according to the second embodiment alone. Elements including an attachment portion 121 (including an attachment protrusion 121*a* and an attachment recess 121*b*), a base portion 122, an upper surface shield plate 123, a side surface shield plate 124, a shield terminal 126*a*, and a signal terminal 126*b* are similar to the counterparts in the inner housing module 20 according to the first embodiment. An inner housing fixing portion 122*a*, a hole portion 122*b*, and a spring portion 125 also have similar configurations.

The inner housing module 120 is different from the inner housing module 20 in the following point. Specifically, a bent piece 127 extends from a side surface of the upper surface shield plate 123 opposite to the side surface shield plate 124 extending from the upper surface shield plate 123 toward one side surface.

The bend piece 127 is described with reference to FIGS. 10A-10D illustrating a configuration where the inner housing module 120 is divided, along a diagonal line in the cross-sectional view, into two inner housings 120A and 120B. As illustrated in FIG. 10A to FIG. 10D, the bent piece 127 extends from a front end (on the side of the receptacle connector RC) of the upper surface shield plate 123 of each of the inner housing modules 120A and 120B, toward the side surface on the side opposite to the side surface shield plate 124.

The bent piece 127 extending from the upper surface shield plate 123 of each of the inner housing modules 120A and 120B comes into contact with the side surface shield plate 124 of the opposite one of the inner housing modules 120B and 120A. With this configuration, connection can be established in gaps between the upper surface shield plate 123 of each of the inner housing modules 120A and 120B and the side surface shield plate 124 of an opposite one of the inner housing modules 120B and 120A. Thus, the two upper surface shield plates 123 and the two side surface shield plates 124 can be in an annular form, whereby shielding effect can further be improved.

The preferred embodiments of the disclosure are described in detail above. The embodiments described above do not limit the disclosure, and can be modified and changed in various ways without departing from the gist of the disclosure described in Claims.

The invention claimed is:

1. A connector that is connected to a mating connector, the connector comprising:

an outer housing; and an inner housing module fit in the outer housing, wherein the inner housing module includes:

a resin portion including an attachment portion and a base portion extending from the attachment portion;

upper surface shield plates and side surface shield plates that are provided on an outer side of the base portion, and are electrically connected to each other; and a signal terminal provided on an inner side of the base portion, and the upper surface shield plates, the side surface shield plates, the signal terminal, and the resin portion are integrally formed in a monolithic construction.

2. The connector according to claim 1, wherein the inner housing module includes two divided segments that each have a substantially L shape in a cross-sectional view, and are combined with one flipped upside down relative to the other.

3. The connector according to claim 1, wherein the outer housing includes shield plate insertion grooves into which the upper surface shield plates and the side surface shield plates of the inner housing module are inserted.

4. The connector according to claim 1, wherein the inner housing module further includes a bent piece extending from a side surface of each upper surface shield plate, the piece being opposite to the respective side surface shield plate.

5. A connector assembly comprising a connector and a mating connector fit to each other, wherein the connector is the connector according to claim 1, and the mating connector includes a mating signal terminal, mating shield plates, and a mating housing that accommodates the mating signal terminal and the mating shield plates, the mating signal terminal and the mating shield plates being connected to the signal terminal, the upper surface shield plates, and the side surface shield plates electrically connected to the upper surface shield plates of the connector.

6. A connector that is connected to a mating connector, the connector comprising:

an outer housing; and an inner housing module fit in the outer housing, wherein the inner housing module includes:

a resin portion including an attachment portion and a base portion extending from the attachment portion;

upper surface shield plates and side surface shield plates that are provided on an outer side of the base portion, and are electrically connected to each other; and a signal terminal provided on an inner side of the base portion, and the upper surface shield plates, the side surface shield plates, the signal terminal, and the resin portion are integrally formed, wherein the inner housing module includes two divided segments that each have a substantially L shape in a cross-sectional view, and are combined with one flipped upside down relative to the other.

7. The connector according to claim 6, wherein the outer housing includes shield plate insertion grooves into which the upper surface shield plates and the side surface shield plates of the inner housing module are inserted.

8. The connector according to claim 6, wherein the inner housing module further includes a bent piece extending from a side surface of each upper surface shield plate, the bent piece being opposite to the respective side surface shield plate.

9. A connector assembly comprising a connector and a mating connector fit to each other, wherein the connector is the connector according to claim 6, and the mating connector includes a mating signal terminal, mating shield plates, and a mating housing that accommodates the mating signal terminal and the mating shield plates, the mating signal terminal and the mating shield plates being connected to the signal terminal, the upper surface shield plates, and the side surface shield plates electrically connected to the upper surface shield plates of the connector.

10. A connector that is connected to a mating connector, the connector comprising:

an outer housing; and an inner housing module fit in the outer housing, wherein the inner housing module includes:

a resin portion including an attachment portion and a base portion extending from the attachment portion;

upper surface shield plates and side surface shield plates that are provided on an outer side of the base portion, and are electrically connected to each other; and a signal terminal provided on an inner side of the base portion, and the upper surface shield plates, the side surface shield plates, the signal terminal, and the resin portion are integrally formed, wherein the outer housing includes shield plate insertion grooves into which the upper surface shield plates and the side surface shield plates of the inner housing module are inserted.

11. The connector according to claim 10, wherein the inner housing module further includes a bent piece extending from a side surface of each upper surface shield plate, the bent piece being opposite to the respective side surface shield plate.

12. A connector assembly comprising a connector and a mating connector fit to each other, wherein the connector is the connector according to claim 10, and the mating connector includes a mating signal terminal, mating shield plates, and a mating housing that accommodates the mating signal terminal and the mating shield plates, the mating signal terminal and the mating shield plates being connected to the signal terminal, the upper surface shield plates, and the side surface shield plates electrically connected to the upper surface shield plates of the connector.

13. A connector that is connected to a mating connector, the connector comprising:

an outer housing; and an inner housing module fit in the outer housing, wherein the inner housing module includes:

a resin portion including an attachment portion and a base portion extending from the attachment portion;

upper surface shield plates and side surface shield plates that are provided on an outer side of the base portion, and are electrically connected to each other; and a signal terminal provided on an inner side of the base portion, and the upper surface shield plates, the side surface shield plates, the signal terminal, and the resin portion are integrally formed, wherein the inner housing module further has a bent piece extending from a side surface of each upper surface shield plate, the bent piece being opposite to the respective side surface shield plate, the bent piece of one inner housing module configured to overlap the side surface shield plate of the other one of the inner housing modules.

14. A connector assembly comprising a connector and a mating connector fit to each other, wherein the connector is the connector according to claim 13, and the mating connector includes a mating signal terminal, mating shield plates, and a mating housing that accommodates the mating signal terminal and the mating shield plates, the mating signal terminal and the mating shield plates being connected to the signal terminal, the upper surface shield plates, and the side surface shield plates electrically connected to the upper surface shield plates of the connector.

* * * * *